US009578939B2

(12) United States Patent
Nebeling

(10) Patent No.: US 9,578,939 B2
(45) Date of Patent: Feb. 28, 2017

(54) ROLLING LUGGAGE APPARATUS HAVING AN INTEGRAL CUP HOLDER

(71) Applicant: Thomas Nebeling, New York, NY (US)

(72) Inventor: Thomas Nebeling, New York, NY (US)

( * ) Notice: Subject to any disclaimer, the term of this patent is extended or adjusted under 35 U.S.C. 154(b) by 0 days.

(21) Appl. No.: 15/003,905

(22) Filed: Jan. 22, 2016

(65) Prior Publication Data

US 2016/0242517 A1 Aug. 25, 2016

Related U.S. Application Data

(60) Provisional application No. 62/119,332, filed on Feb. 23, 2015.

(51) Int. Cl.

| | |
|---|---|
| ***A45C 5/00*** | (2006.01) |
| ***A45C 5/14*** | (2006.01) |
| ***A45C 13/00*** | (2006.01) |
| *A45C 15/00* | (2006.01) |

(52) U.S. Cl.

CPC ..... *A45C 5/14* (2013.01); *A45C 13/001* (2013.01); *A45C 15/00* (2013.01); *A45C 2200/20* (2013.01)

(58) Field of Classification Search

CPC ..... A45C 5/14; A45C 13/001; A45C 13/005; A45C 13/262; A45C 2013/267

USPC ..... 280/47.17

See application file for complete search history.

(56) References Cited

U.S. PATENT DOCUMENTS 5,040,719 A * 8/1991 Ballway ..... A47G 19/2205 215/10
D340,012 S * 10/1993 Azzarelli ..... D12/130
5,413,035 A * 5/1995 Fernandez ..... B60N 3/005 100/44
5,551,558 A * 9/1996 Bureau ..... A45C 9/00 190/11
5,660,310 A * 8/1997 LeGrow ..... B60R 7/043 224/275
6,067,816 A * 5/2000 Hodosh ..... A45C 11/20 220/592.17
6,279,706 B1 * 8/2001 Mao ..... A45C 5/14 16/113.1
6,298,964 B1 * 10/2001 Sadow ..... A45C 5/14 190/115
6,328,146 B1 * 12/2001 Siwak ..... A45C 3/00 150/106
6,390,431 B1 * 5/2002 Ott ..... A45C 13/00 248/229.23
6,481,239 B2 * 11/2002 Hodosh ..... A45C 11/20 220/592.17
6,609,599 B1 * 8/2003 Chang ..... A45C 13/02 16/113.1
D492,486 S * 7/2004 Mullins ..... D3/279
(Continued)

*Primary Examiner* — Hau Phan

*Assistant Examiner* — Jacob Meyer

(74) *Attorney, Agent, or Firm* — Malina & Associates, PLLC

(57) ABSTRACT

A luggage apparatus includes a front shell and a rear shell which are connected by a zipper closure and a hinge. A cup bolder includes a body portion which projects into the interior of the front shell. The cup holder includes a rim which rests on the outer surface of the front shell. The rear shell includes a telescoping handle and lower surfaces of the front and rear shells each have caster-type wheels. The front shell includes a fabric liner which prevents damage to items stored in the apparatus in the event that there is an accidental spill from the cup holder.

7 Claims, 5 Drawing Sheets

(56) References Cited

U.S. PATENT DOCUMENTS 6,793,051 B2 * 9/2004 Siwak ..... A45C 3/00 190/111
6,866,008 B1 * 3/2005 Havard ..... A01K 1/0236 119/496
7,309,106 B2 * 12/2007 Stallman ..... A47C 15/004 297/188.09
7,510,157 B2 * 3/2009 Oliver ..... A45C 13/28 220/739
7,668,309 B2 * 2/2010 Wilcox ..... B60R 11/0241 379/454
7,708,247 B2 * 5/2010 Lota ..... B60N 3/10 224/926
8,235,190 B2 * 8/2012 Porte ..... A45C 5/14 190/100
8,307,966 B2 * 11/2012 Cummins ..... A45F 5/00 190/102
8,382,053 B2 * 2/2013 Webb ..... A47G 23/02 248/146
8,485,327 B1 * 7/2013 Dalrymple ..... A45C 9/00 190/11
8,944,459 B1 * 2/2015 Hagy ..... B62B 3/02 280/47.34
9,084,491 B1 * 7/2015 Kattan ..... A47B 5/00
9,101,186 B2 * 8/2015 Lai ..... A45C 7/0027
9,307,815 B2 * 4/2016 Sijmons ..... A45C 5/03
2002/0148868 A1 * 10/2002 Dion-Bildstein ..... B60N 3/103 224/401
2006/0022006 A1 * 2/2006 Cruise ..... A45C 7/0077 224/572
2006/0037825 A1 * 2/2006 Dayton ..... A45C 13/28 190/110
2006/0219745 A1 * 10/2006 Riley ..... A47G 23/0225 224/400
2006/0243768 A1 * 11/2006 Dowell ..... B60R 11/00 224/400
2009/0051133 A1 * 2/2009 Oshiro ..... A63B 67/06 280/47.18
2011/0048882 A1 * 3/2011 Chiang ..... A45C 5/03 190/107
2012/0247897 A1 * 10/2012 Sheikh ..... A45C 13/262 190/115
2012/0273314 A1 * 11/2012 Raymond ..... A45C 13/28 190/18 A
2013/0049315 A1 * 2/2013 Lowe ..... B62B 1/12 280/47.315
2014/0110202 A1 * 4/2014 Vesterby ..... A45C 13/001 190/103
2014/0311844 A1 * 10/2014 Meersschaert ..... A45C 5/02 190/122
2015/0150348 A1 * 6/2015 Wax ..... A45C 5/03 190/18 A

* cited by examiner 10
14
32
16
2
34
30
3
38
12
36
40
2
42
22
26
20
3
18
24

ROLLING LUGGAGE APPARATUS HAVING AN INTEGRAL CUP HOLDER

The present application claims priority from my Provisional Patent Application, titled. Rolling Luggage Apparatus Having an Integral Cup Holder, Ser. No. 62/119,332, filed on Feb. 23, 2015.

FIELD OF THE INVENTION

The present invention relates generally to the field of suitcases and more particularly to a roiling luggage apparatus having an integral cup holder.

BACKGROUND OF THE INVENTION

Travelers in airports and other travel locations typically experience, difficulty managing their luggage and other travel items. Typically, travelers need to manage a suitcase, a knapsack or purse and a laptop computer. When travelers wish to purchase a beverage, the need to manage all of the travel items and the need to also carry the beverage leads to a degree of awkwardness which can result in spilling the beverage or misplacing some or the other items being carried.

OBJECTS AND SUMMARY OF THE INVENTION

It is an object of the present invention to provide a rolling luggage apparatus having an integral cup holder which can support a beverage without spilling.

Another object of the present invention is to provide a rolling luggage apparatus having an an integral cup holder which does not interfere with the normal use of the luggage for storage and transportation of items.

Yet another object of the present invention is to provide a rolling luggage apparatus having an integral cup holder which can be manufactured economically in volume resulting in a relatively low unit cost.

In accordance with the present invention there is provided a rolling luggage apparatus having an integral cup holder.

The apparatus includes a front shell and a rear shell which are connected by a zipper closure and a hinge. One cup holder includes a body portion which projects into the interior of the volume which formed when the zipper is closed. The cup holder includes a rim which rests on the outer surface of the from shell. The rear shell includes a conventional telescoping handle and lower surfaces of the front and rear shells each having a conventional caster-type wheels. The front shell includes a fabric liner which prevents damage to items stored in the apparatus even if there is an accidental spill from the cup holder.

DETAILED DESCRIPTION OF THE INVENTION

Figure 1:
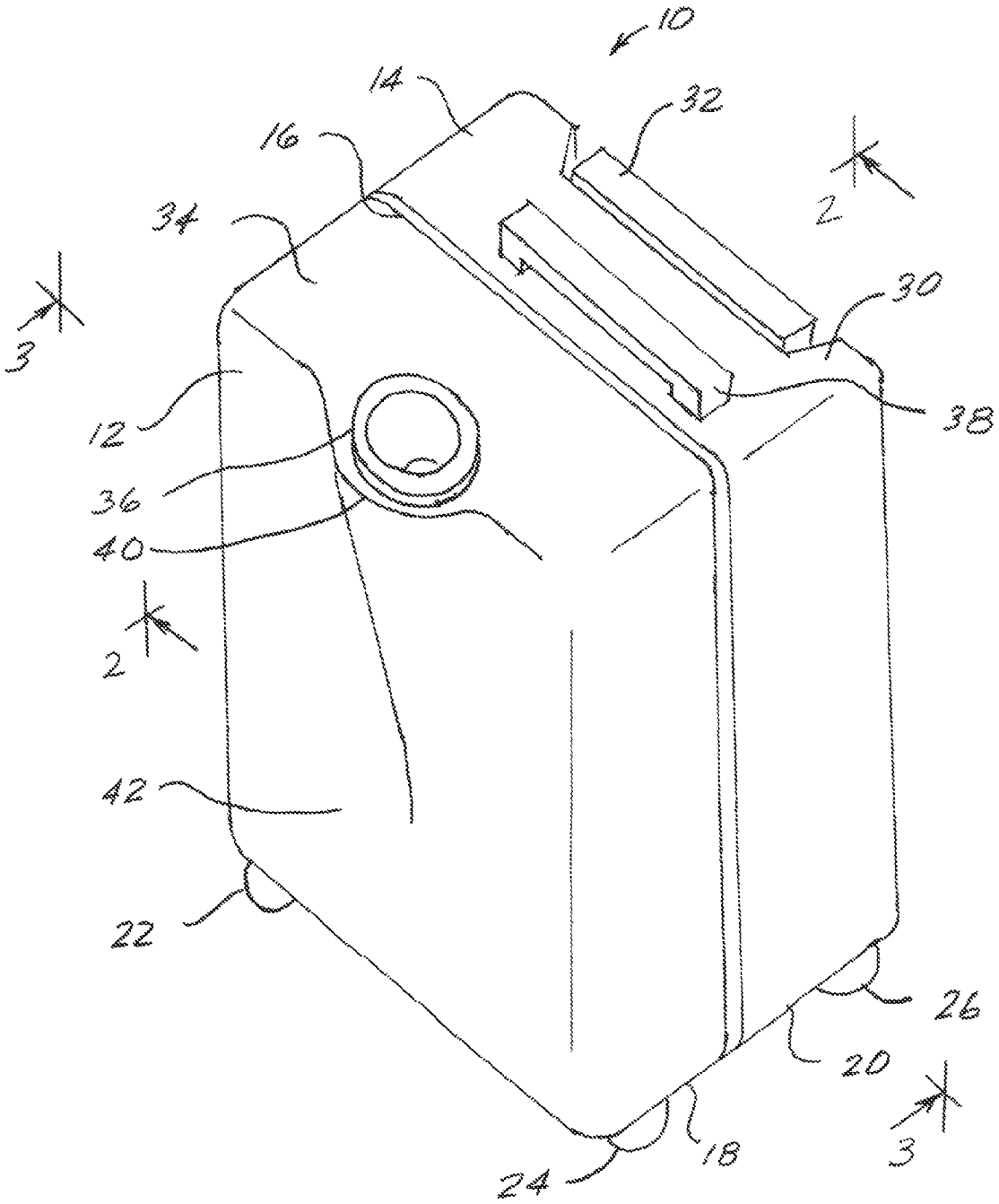
FIG. 1 is an overall perspective view of a rolling luggage apparatus having an integral cup holder made according to the resent invention.

With reference to the drawings, there is shown in FIG. 1 a rolling luggage apparatus having an integral cup holder 10 made according to the present invention. The apparatus 10 includes a front shell 12 and a rear shell 14 which are connected on peripheral edges by an outer zipper closure 16 and a conventional hinge which has not been illustrated, to form a hollow generally rectangular suitcase. The bottom surfaces 18, 20 of the apparatus 10 include two identical conventional caster-type wheels 22, 24, 26. One of the four wheels has not been illustrated. The top surface 30 of the apparatus 10 further includes a fixed handle 38, a telescoping handle 32, and the top surface 34 and a cup holder 36.

The outer zipper closure 16, the fixed handle 38 and the caster-type wheels are all conventional in nature well known in the art, and therefore need not be further described. The top surface 34 supports the cup holder 36 and the cup holder 36 form a key feature of the present invention.

Figure 5:
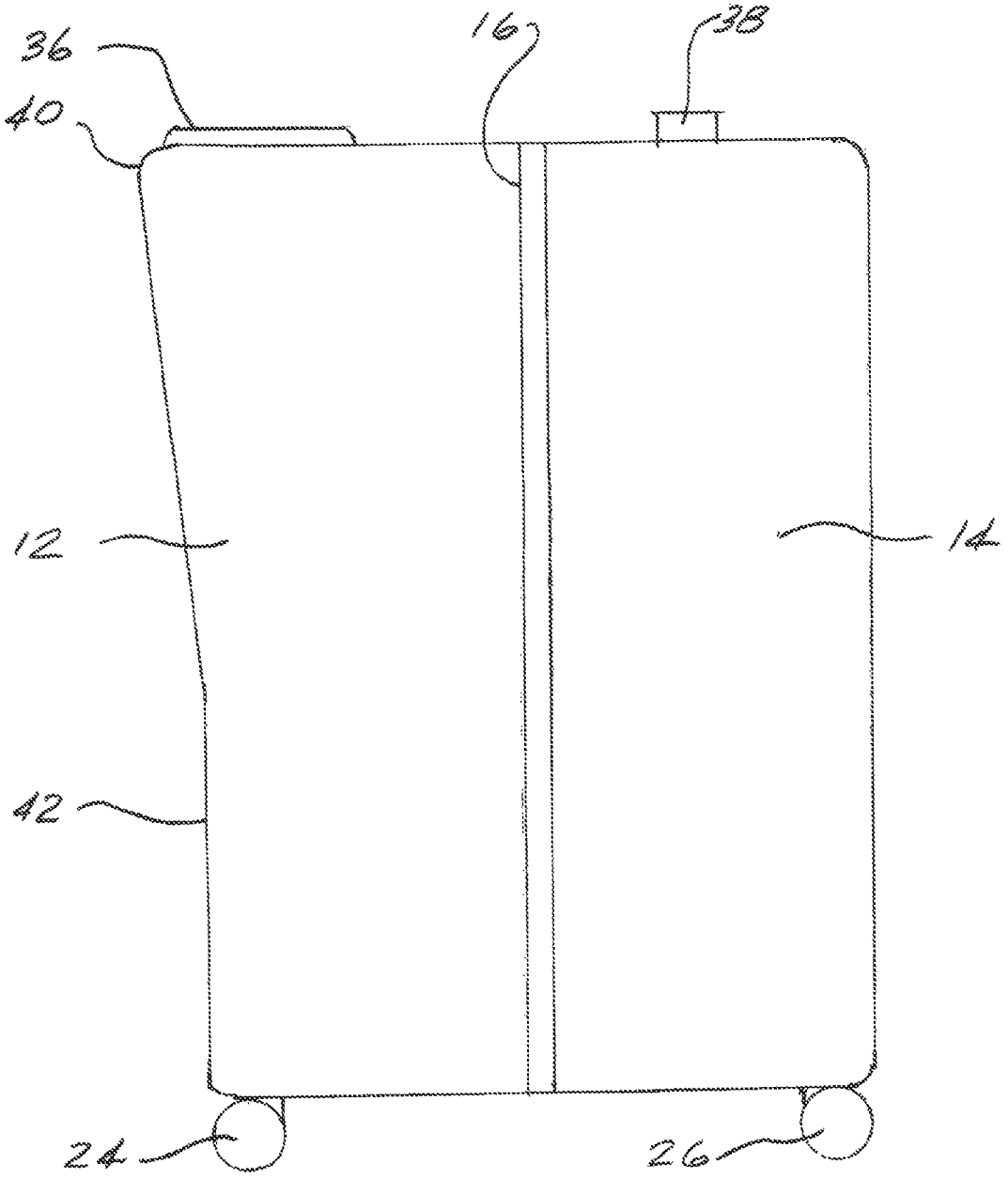
FIG. 5 is a side view of a rolling luggage apparatus having an integral cup bolder of FIG. 1.

The top surface 34 includes an integrally formed outwardly projecting portion 40 which tapers to blend smoothly with the front surface 42, as is best shown in FIG. 5.

Figure 2:
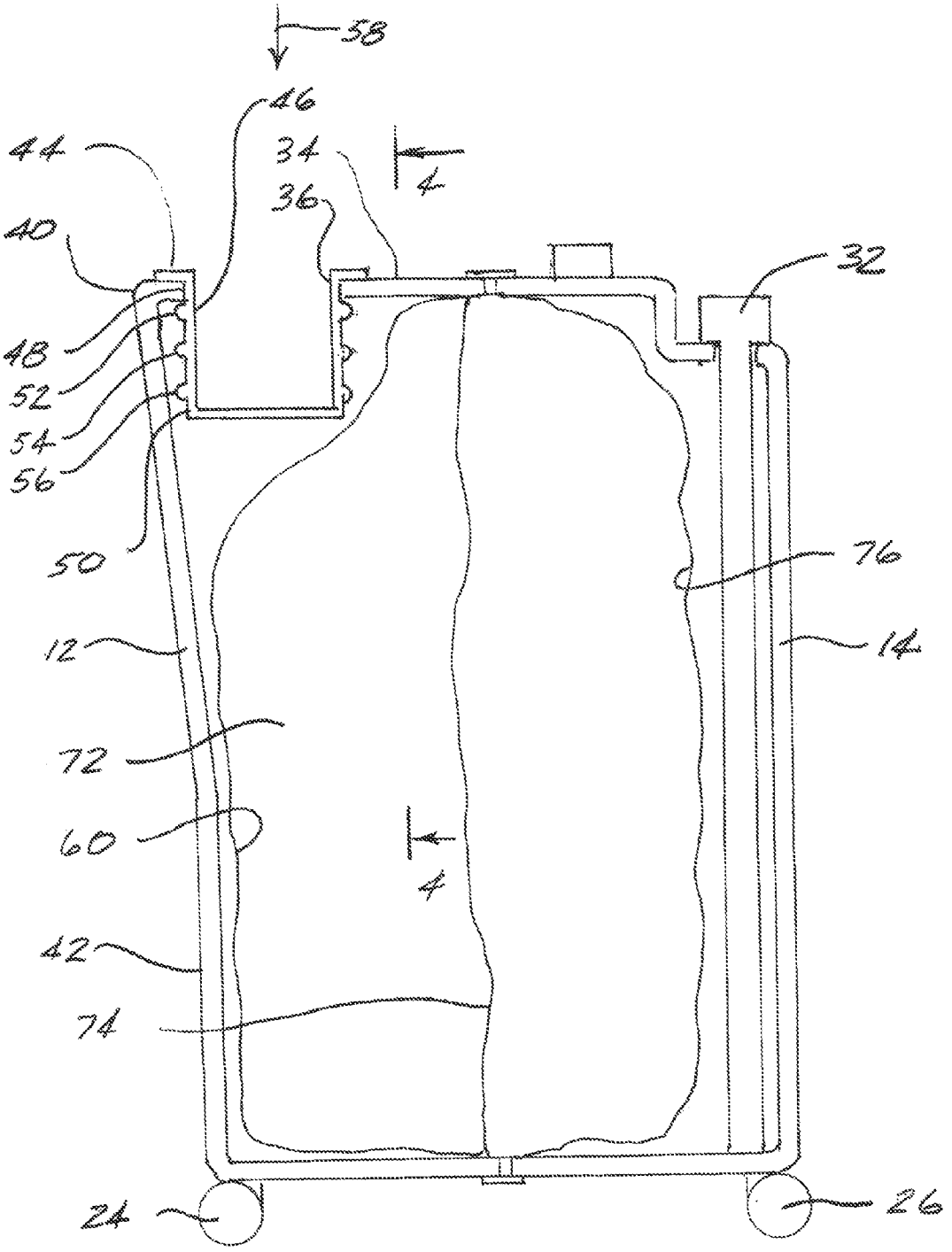
FIG. 2 is a cross sectional view taken along the line 2-2 of FIG. 1.
Figure 3:
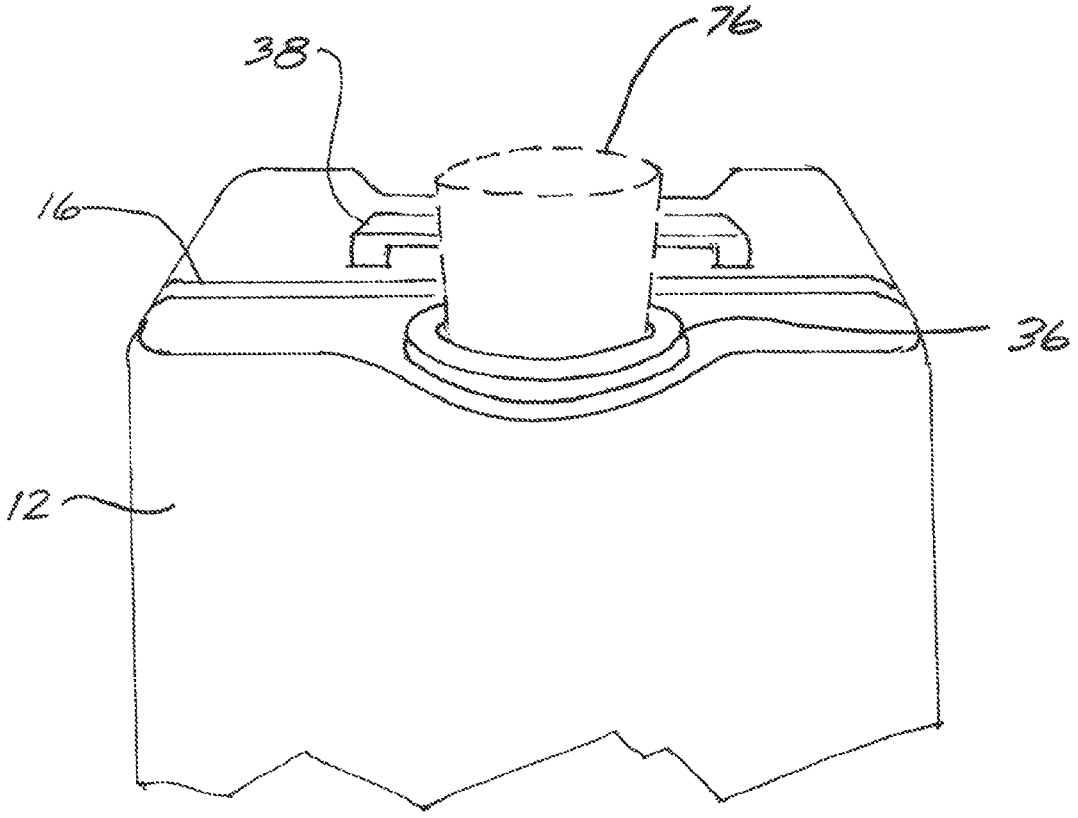
FIG. 3 is a fragmentary front perspective view of the rolling luggage apparatus having an integral cup holder of FIG. 1 taken along the line 3-3 of FIG. 1 and showing a cup, shown in broken lines in place in the cup holder.

As is best shown in FIG. 2 the cup holder 36 has a rim 44 which rests on the top surface 34. The body 46 of the cup holder 36 projects through an aperture 48 formed in the shell 12. The outer surface 50 of the body 46 of the cup holder 36 includes plurality of ridges 52, 54, 56, which preferably encircle the curved body 46. Each of the ridges 52, 54, 56 has a diameter slightly larger than the diameter of the apparatus 48 in the shell 12. During assembly, when the cup holder 36 is pressed into the shell 12 in the direction shown by the arrow 58 in FIG. 2, the shell 12 flexes to permit the insertion of the cup holder 36. The ridges 52, 54, 56 prevent the cup holder 36 from falling out of the shell 12.

Alternatively, the ridges 52, 54, 56 may be replaced by a single ridge which is similar on the ridges 52, 54, 56 but which partially encircles the body 46.

Figure 4:
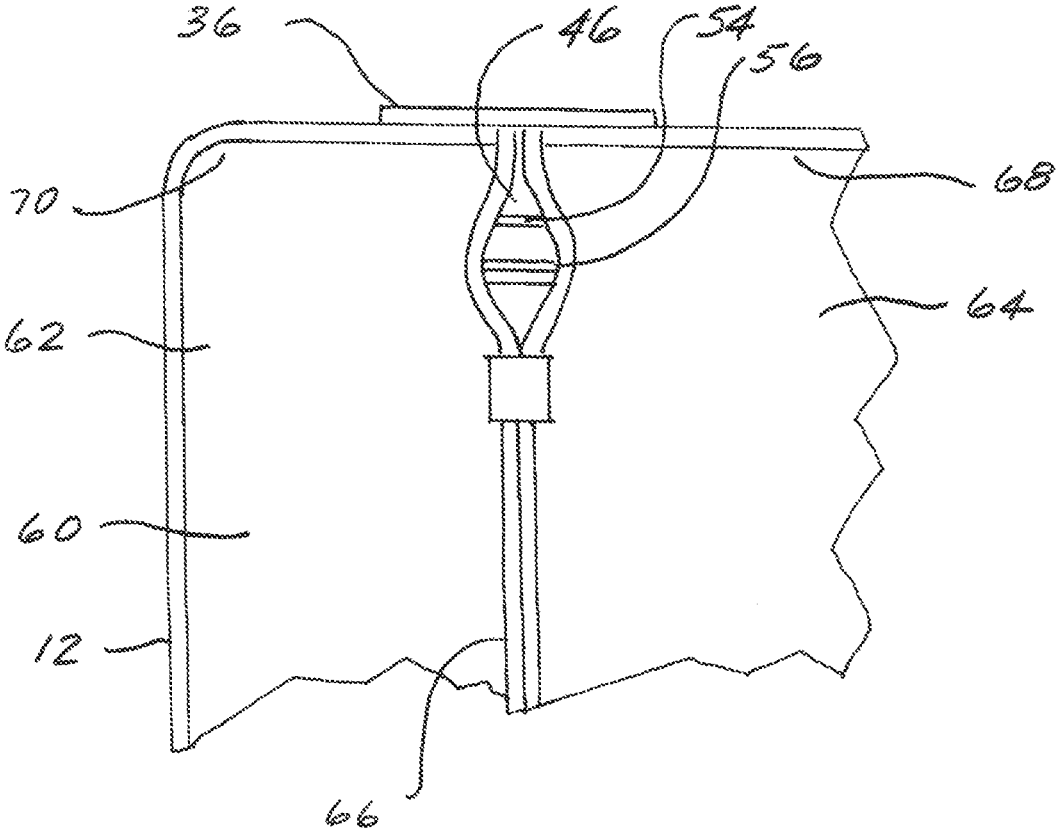
FIG. 4 is a fragmentary cross-sectional view taken along the line 4-4 of FIG. 2, and showing the zipper closure on the liner partially opened to reveal details of internal construction.

FIG. 4 shows the inner liner 60 which has a first half 62 and a second half 64 which, during use, are connected by a zipper closure 66. Peripheral edges 68, 70 of the inner liner 60 are attached to the shell 12 by conventional attachment means such as stitching or an adhesive layer, which have not been illustrated. FIG. 4 shows the zipper closure 66 partially opened to show the cup holder 36. When the zipper closure 66 is closed, the body 46 of the cup holder 36 is completely enclosed. Clothing and other goods may be placed in the compartment 72 defined by the inner liner 60 and the storage liner 74. The inner liner 60 protects the clothing or other goods against accidental spillage from the cup holder 36. The rear liner 76 covers the telescoping handle 32.

FIG. 5 shows the apparatus 10 in use with a cup 76 which is shown in broken lines inserted in the cup holder 36. The four wheels, previously described, facilitate moving the apparatus 10 while maintaining an upright orientation thereby minimizing the possibility of spilling liquids contained in the cup 76.

The foregoing specific embodiment of the present invention as set forth in the specification herein is for illustrative purposes only. Various deviations and modifications may be made within the spirit and scope of the invention without departing from the main theme thereof.

What is claimed is:

1. A rolling luggage apparatus having an integral cup holder comprising:

a hollow shell assembly comprising a front shell and a rear shell, the front shell having a top surface;

a zipper closure connecting the front shell to the rear shell;

a cup holder having an open mouth defined by a circular rim resting on the top surface of the front shell; the cup holder further having a body portion defining a cavity and an outer wall;

at least one rib formed on the outer wall of the body portion, with the body portion projecting into the front shell;

at least one pair of wheels mounted on the hollow shell assembly;

a telescoping handle disposed on the rear shell; and a further handle disposed on the rear shell.

2. The rolling luggage apparatus having an integral cup holder as claimed in claim 1 wherein said front shell and said rear shell are each generally rectangular.

3. The rolling luggage apparatus having an integral cup holder as claimed in claim 1 wherein the front shell further comprises:

a tapered portion.

4. The rolling luggage apparatus having an integral cup holder as claimed in claim 1 wherein the rib encircles the body portion.

5. The rolling luggage apparatus having an integral cup holder as claimed in claim 1 wherein the rib partially encircles the body portion.

6. The rolling luggage apparatus having an integral cup holder as claimed in claim 1 further comprising a liner disposed in the first shell and disposed to cover below and adjacent the body portion of the cup holder.

7. The rolling luggage apparatus having an integral cup holder as claimed in claim 6 wherein the liner comprises a flexible fabric liner.

* * * * *